US009914582B2

(12) United States Patent
Jørgensen

(10) Patent No.: US 9,914,582 B2
(45) Date of Patent: Mar. 13, 2018

(54) PACKAGING FOR A WINDOW AND A METHOD FOR PACKING

(71) Applicant: VKR HOLDING A/S, Hørsholm (DK)

(72) Inventor: Christian Taulov Jørgensen, Kolding (DK)

(73) Assignee: VKR Holding A/S, Horsholm (DK)

( * ) Notice: Subject to any disclaimer, the term of this patent is extended or adjusted under 35 U.S.C. 154(b) by 39 days.

(21) Appl. No.: 14/349,606

(22) PCT Filed: Oct. 4, 2012

(86) PCT No.: PCT/DK2012/050373

§ 371 (c)(1),
(2) Date: Apr. 3, 2014

(87) PCT Pub. No.: WO2013/050041

PCT Pub. Date: Apr. 11, 2013

(65) Prior Publication Data

US 2014/0238879 A1 Aug. 28, 2014

(30) Foreign Application Priority Data

Oct. 4, 2011 (DK) ..... 2011 70546

(51) Int. Cl.
*B65D 85/46* (2006.01)
*B65D 85/00* (2006.01)
(Continued)

(52) U.S. Cl.
CPC ..... *B65D 85/00* (2013.01); *B65B 11/004* (2013.01); *B65B 23/20* (2013.01); *B65D 5/5088* (2013.01);
(Continued)

(58) Field of Classification Search
CPC .... B65D 5/6605; B65D 5/6629; B65D 65/02; B65D 85/46; B65D 85/00; B65D 85/48;
(Continued)

(56) References Cited

U.S. PATENT DOCUMENTS 1,516,090 A * 11/1924 Gary ..... B65D 5/542 229/155
2,024,832 A 3/1934 Myers
(Continued)

FOREIGN PATENT DOCUMENTS

DK PCT/DK9900623 5/2000
EP 1710163 A1 10/2006
WO PCT/US2003/023089 1/2004

*Primary Examiner* — J. Gregory Pickett
*Assistant Examiner* — Rafael Ortiz
(74) *Attorney, Agent, or Firm* — Timothy D. St. Clair; Parker Poe Adams & Bernstein, LLP

(57) ABSTRACT

A packaging for a window comprising a folded sheet member and at least one fastener or bonder for interconnecting different sections of the sheet member for the formation of a box, where two lid sections are each connected to a side section of the sheet member. The sum of the widths of the lid sections is substantially equal to the width of a receiving section intended for carrying the window and the lid sections have different widths. The width of each lid section corresponds to at least ¼ of the width of the receiving section. Preferably, the packaging comprises an indication that it should be opened at the joint between the two lid sections and one of the lid sections preferably has a standard width regardless of the size of the packaging, preferably approximately 40 cm. A packed window and a method for packing a window is also part of the invention.

13 Claims, 5 Drawing Sheets

(51) Int. Cl.

| | |
|---|---|
| ***B65B 11/00*** | (2006.01) |
| ***B65B 23/20*** | (2006.01) |
| ***B65D 5/50*** | (2006.01) |
| ***B65D 5/54*** | (2006.01) |
| ***B65D 51/18*** | (2006.01) |
| ***B65D 85/48*** | (2006.01) |

(52) U.S. Cl.
CPC ..... *B65D 5/548* (2013.01); *B65D 51/18* (2013.01); *B65D 85/48* (2013.01)

(58) Field of Classification Search
CPC ..... B65D 5/5088; B65D 5/548; B65D 51/18; E06B 7/00; B65B 11/004; B65B 23/20
USPC ..... 206/321, 322, 325, 386, 598, 454, 588, 206/448; 229/103.2, 237

See application file for complete search history.

(56) References Cited

U.S. PATENT DOCUMENTS

| | | | | | |
|---|---|---|---|---|---|
| 2,043,419 | A * | 6/1936 | Robinson | B65D 75/14 | 206/321 |
| 2,596,261 | A | 4/1950 | Liskin | | |
| 3,335,857 | A * | 8/1967 | Saferstein | B65D 85/48 | 206/454 |
| 3,586,234 | A * | 6/1971 | Nathan | B65D 5/4204 | 206/322 |
| 3,804,237 | A * | 4/1974 | Christensen | B65D 65/12 | 206/450 |
| RE28,460 | E * | 7/1975 | Rous | B65D 5/2009 | 206/424 |
| 3,939,978 | A * | 2/1976 | Thomaswick | B65D 5/5033 | 206/453 |
| 4,032,009 | A * | 6/1977 | Taylor | B65D 5/16 | 206/321 |
| 6,594,973 | B1 * | 7/2003 | Alpert | B65D 5/5035 | 125/9 |
| 2003/0155258 | A1 * | 8/2003 | Tu | B65B 5/04 | 206/321 |
| 2008/0164173 | A1 * | 7/2008 | Savakus | B65D 57/00 | 206/454 |

* cited by examiner

PACKAGING FOR A WINDOW AND A METHOD FOR PACKING

The present invention relates to a packaging for a window comprising a folded sheet member having a receiving section intended for carrying the window, two side sections, two end sections and one or more lid sections forming a top surface of the packaging in the assembled state, said sections being separated from each other by fold lines, and at least one fastener or bonder interconnecting different sections of the sheet member for the formation of a box.

Such packaging is usually made from cardboard, often corrugated cardboard. Different sections of the sheet member are interconnected by means of clamps, glue and tape to make the box sufficiently strong to accommodate the window during handling and transportation. To avoid damages caused by the window moving within the box, it is made to fit the size of the window including any additional packing material, such as shock absorbing material, with only a minimal over-size. Flashing kits, insulations, vapour barrier collars and like components to be used during mounting of the windows are usually delivered in separate boxes.

Box packaging is used for windows of standardized sizes, which are made for stock and often used one or a few at a time in smaller buildings or for renovation purposes, whereas windows made in customised sizes or large numbers to be used in a single building are traditionally delivered on pallets.

The boxed windows are often bought and mounted by persons having little or no experience, and consequently the risk of errors is relatively high. Not only when mounting the window, but also with regards to picking the right window off the shelf in a do-it-yourself store or at the building materials retailers and with regards to unpacking and handling the product properly.

Information on the outside of window packaging and not least the instructions included inside has therefore been made very explicit and is constantly improved, whenever problems are discovered. The packaging itself has, however, remained virtually unchanged for decades and the improvements that have been made have been focusing on optimizing the use of the materials, either for environmental or economical reasons, or on adapting the sizes and shapes to meet storage requirements. It is therefore the object of the invention to provide a packaging for a window, which makes it easier for the user to unpack and handle the window.

This is achieved with a packaging comprising two lid sections each connected to a side section of the sheet member, where the sum of the widths of the lid sections measured from the fold line separating each of them from the respective side section to the opposite edge is substantially equal to the width of the receiving section, where the lid sections have different widths and where the width of each lid section corresponds to at least ¼ of the width of the receiving section.

The division of the lid of the box in two sections makes it easy to open the packaging. One can simply stand on one side of the packaging, grip the edge of the lid section and lift it upwards and outwards, away from the window. This is then repeated on the other side to expose the window entirely. Preferably, the side sections are also made to be folded down so that the packaging material comes to lie flat on the ground or floor upon opening of the box. Today, most box packaging for windows are made to be opened at the end section, meaning that the window is exposed by tipping the box so that the window slides out through the opened end.

The new packaging thus eliminates the need for lifting the weight of the window during unpacking and, in addition, the risk of damages to the window if it falls from the box or if the frame edge exiting the box first slides over a rough surface during the subsequent extraction from the box.

Making the lid sections of uneven size means that at least one of them is small enough to be reached over, thus making it easy to reach the joint and get a grip of the edge. A size ratio of at least 1:3 between the two lid sections, corresponding to the width of the smallest lid section constituting at least ¼ of the width of the receiving section, has proven to strike a good balance between ease of handling, stability of the box and production factors.

Moreover, when the lid sections are folded over 180 degrees and the side sections laid down, they constitute a potential receiving surface for the window sash, which usually has to be removed from the window frame before mounting. Hence the risk of the sash or pane being damaged or becoming dirty is also reduced. To give room for this use of the sheet member, it is preferred that the sum of the width of one of the lid sections and the width of the adjacent side section constitutes at least 75% of the width of the receiving section. This may not be enough to lay down the sash, but once the sash unit carrying the heavy pane has been removed it is relatively easy to shift the frame a small distance across the sheet member to make more room if desired.

In an embodiment, the width of one lid section is kept constant regardless of the other dimensions of the box. This eases the production of different size boxes in the same production facility and a width of approximately 40 cm of the lid sections intended to be opened first, has been found to be well received by test-users.

The fasteners and/or bonder used should of course facilitate the intended opening of the packaging. It is presently preferred that the joint between the lid sections is covered by tape, and/or that one lid section overlaps the other, a glue or an adhesive being applied to at least one of the overlapping parts. For an even stronger joining of the different section of the sheet member, a combination of different fasteners and/or bonders may be used, one example being the combination of staples and an adhesive applied between the overlapping parts of the two sections.

When opening the box the interconnection provided by the fasteners or bonder can be broken, but the sheet member could also be provided with a tear-out strip allowing the material of the sheet member. Depending on the type of fasteners or bonder used, these may also be broken or torn by means of such a strip.

It may also be advantageous to have at least one recess, opening or cut-out allowing the formations of a recess or opening at the edge of at least one of the lid sections, said reces(ses) or opening(s) having a size allowing it/them to be used as grip(s). If using a joint with tape or a tear-out strip, the grip is simply used for getting a hold on the edge of the lid section, but if the joint is glued or adhering it may also allow the user to more easily force-break the joint by pulling. It is to be understood that the wording "at the edge" does not mean that the recess(ces) or opening(s) have to be in the actual edge of the material, but merely in the vicinity of the edge.

To make sure that the user understands that this packaging is not to be opened in the traditional manner it may further comprise an indication that it should be opened at the joint between the two lid sections. This may be in the form of instructions on the sheet member, but if using a taped joint the tape itself may serve this purpose, e.g. by having a bright colour, a particular pattern or carrying printed instructions.

To facilitate the opening of the box, the joint between the lid sections and the end sections should preferably be relatively easily broken. This may be achieved by having the end sections project from the receiving section and/or side sections and making the joint between the end sections and lid sections simply as a taped joint. If, however, this is not desired, for example if such a joint does not provide sufficient stiffness for the box to be stable, end sections may project from the lid sections. Weakenings can then be provided at the folds separating lid sections from end sections, said weakenings allowing the material of the sheet member to be torn by hand. Such weakening may for example be in the form of intermittent perforations in the sheet member, for example 20 mm cuts alternating with 10 mm unbroken material, when the sheet member is made from a corrugated cardboard of the type traditionally used for window packaging. A weakening may also be achieved by providing a tear-out strip, which takes away some of the material of the sheet member when being torn out.

Inside the box one or more inserts, preferably made from EPS or cardboard, may be provided for protecting the packed window during handling, storage and transportation. In a preferred embodiment, at least one such insert is a packaging, preferably a box, for holding small parts, such as mounting brackets or fasteners. In this way this smaller packaging serves a double purpose and the need for material, which only has to be disposed of at the installation site, is minimized to the benefit of both the user, the manufacturer and the environment.

Such inserts may be attached to the sheet member before or after the folding of the sheet member, preferably by means of glue or an adhesive.

Likewise, if the packaging is to contain other components associated with the window, such as for example flashing members, cover members, vapour barriers, underroof collars or insulating members, these may be attached to the sheet member in a similar manner. Such attachment will prevent these components from moving inside the packaging during transport and hence minimize the risk of damages to them or to the window, particularly minimizing the risk of scratches on painted, lacquered or like smooth surfaces.

In the following, the invention will be described in closer detail by reference to an embodiment of the invention shown on the drawing, where:

Figure 4:
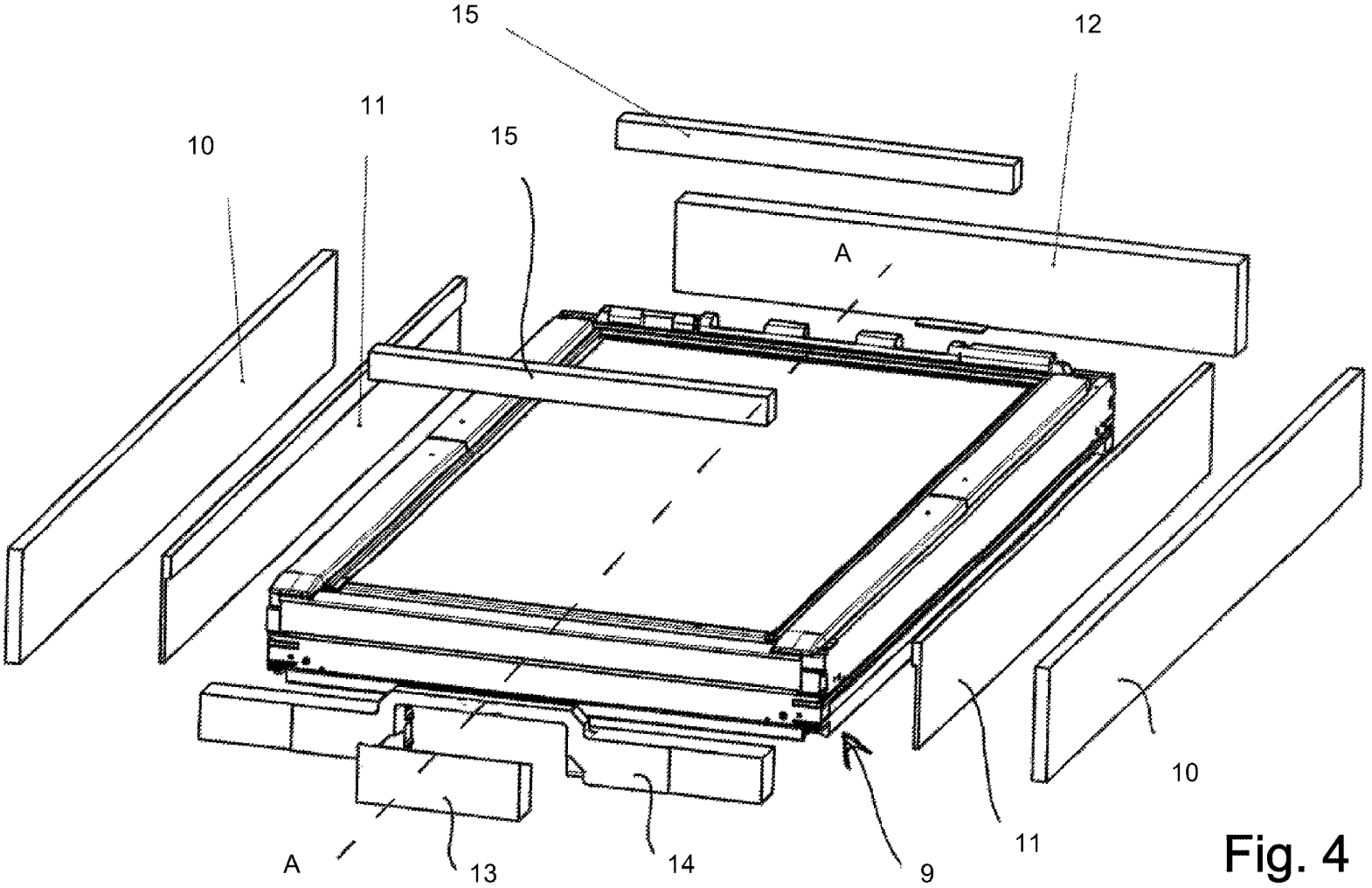
Figure 5:
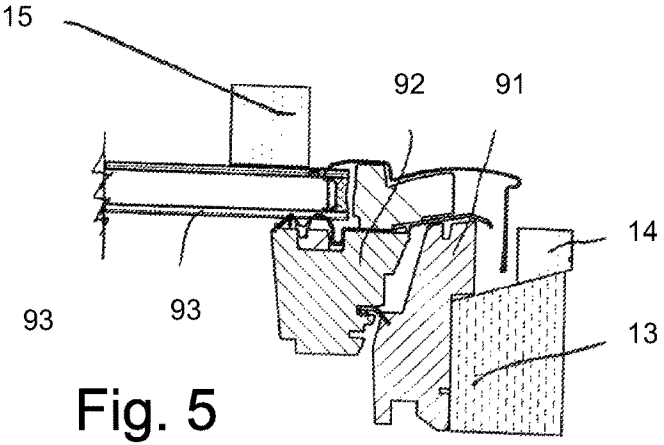
Figure 7:
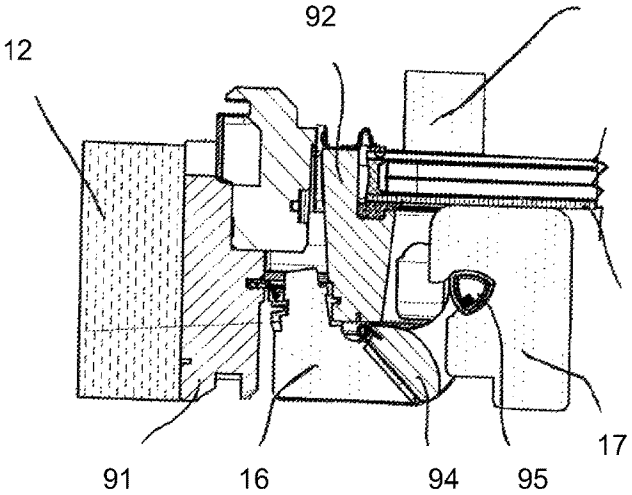
Figure 7:
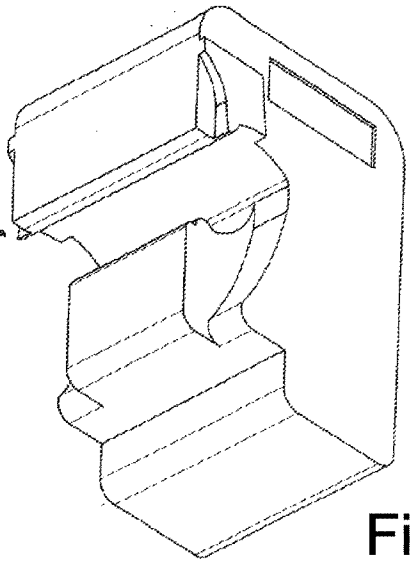
Figure 6:
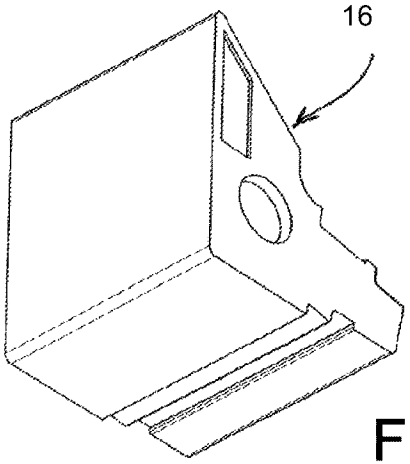
Figure 8:
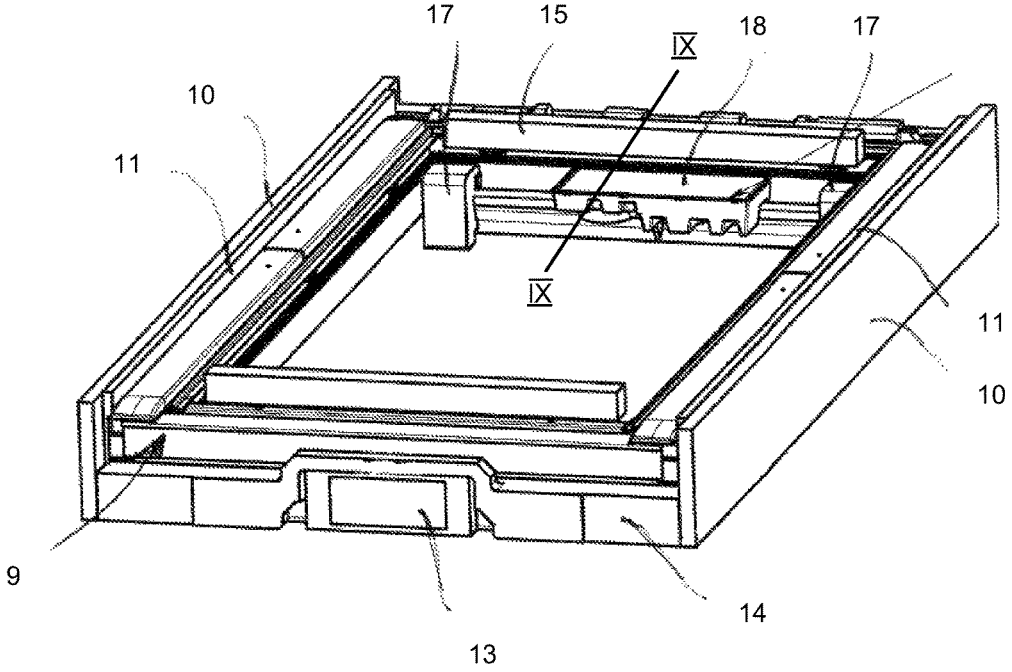
Figure 9:
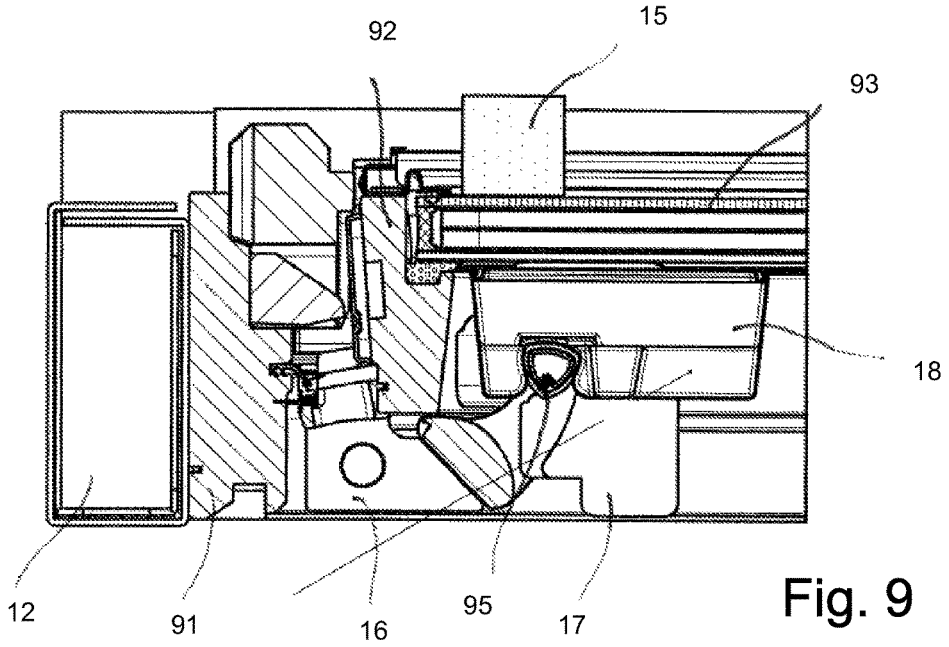

FIG. 4 shows a second embodiment of the packaging after opening in an exploded perspective view, FIG. 5 shows a cross-section along the line A-A in FIG. 4 but not exploded, FIG. 6 shows a foam block for insertion between the window sash and a ventilation flap in a perspective view, FIG. 7 shows a foam block for protection of the handle bar in a perspective view, FIG. 8 shows another embodiment of the content in a packing in a perspective view, and FIG. 9 is a cross-section of the embodiment in FIG. 8 along the line IX-IX and corresponding to the left-hand side of FIG. 5.

Figure 1:
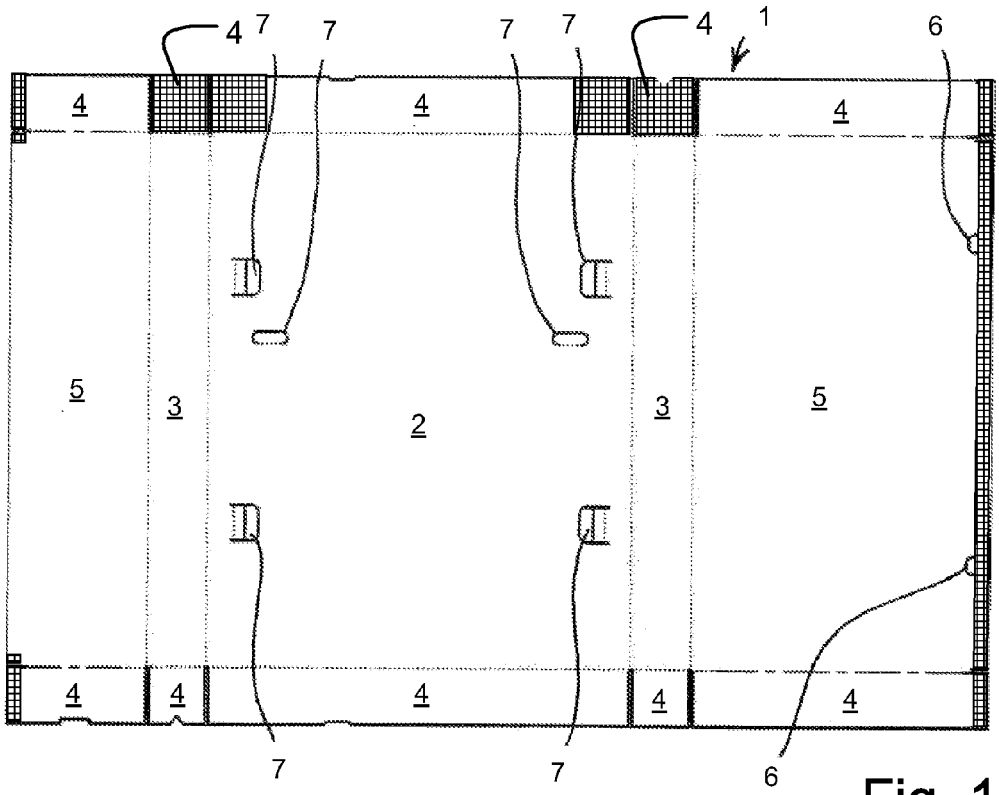
FIG. 1 shows a sheet member for a packaging according to the invention.

A sheet member 1 intended to serve as a blank for forming a packaging according to the invention is shown in FIG. 1. The sheet member comprises a receiving section 2, sides sections 3, end sections 4 and lid sections 5, the borders between which are defined by fold lines, shown as broken lines, and by cuts in the material.

The sheet member 1 may be made from any appropriate material, such as corrugated cardboard of the type traditionally used for window packaging, but other materials such as plastics and composites may also be employed.

In the embodiment shown, end sections 4 are provided on all of the other sections 2, 3, 5 in order to achieve a box with strong ends. This not only helps protect the window from direct impacts, but also provides stiffness, which makes the box relatively stable and well suited for being stacked.

The end sections 4 are also used for the formation of the box. In this embodiment the end sections on the side sections 3 come to overlap the end sections on the receiving section 2 and are attached thereto. The overlaps are hatched on the uppermost end sections in FIG. 1 and these sections of the material may be compressed or otherwise made thinner to avoid the packaging becoming too bulky. The interconnection of the end sections, as well as all other connections mentioned herein, may be made with bonders such as tape, glue or adhesives or with fasteners such as clamps, staples, rivets or string or with any other suitable device or material.

Figure 2:
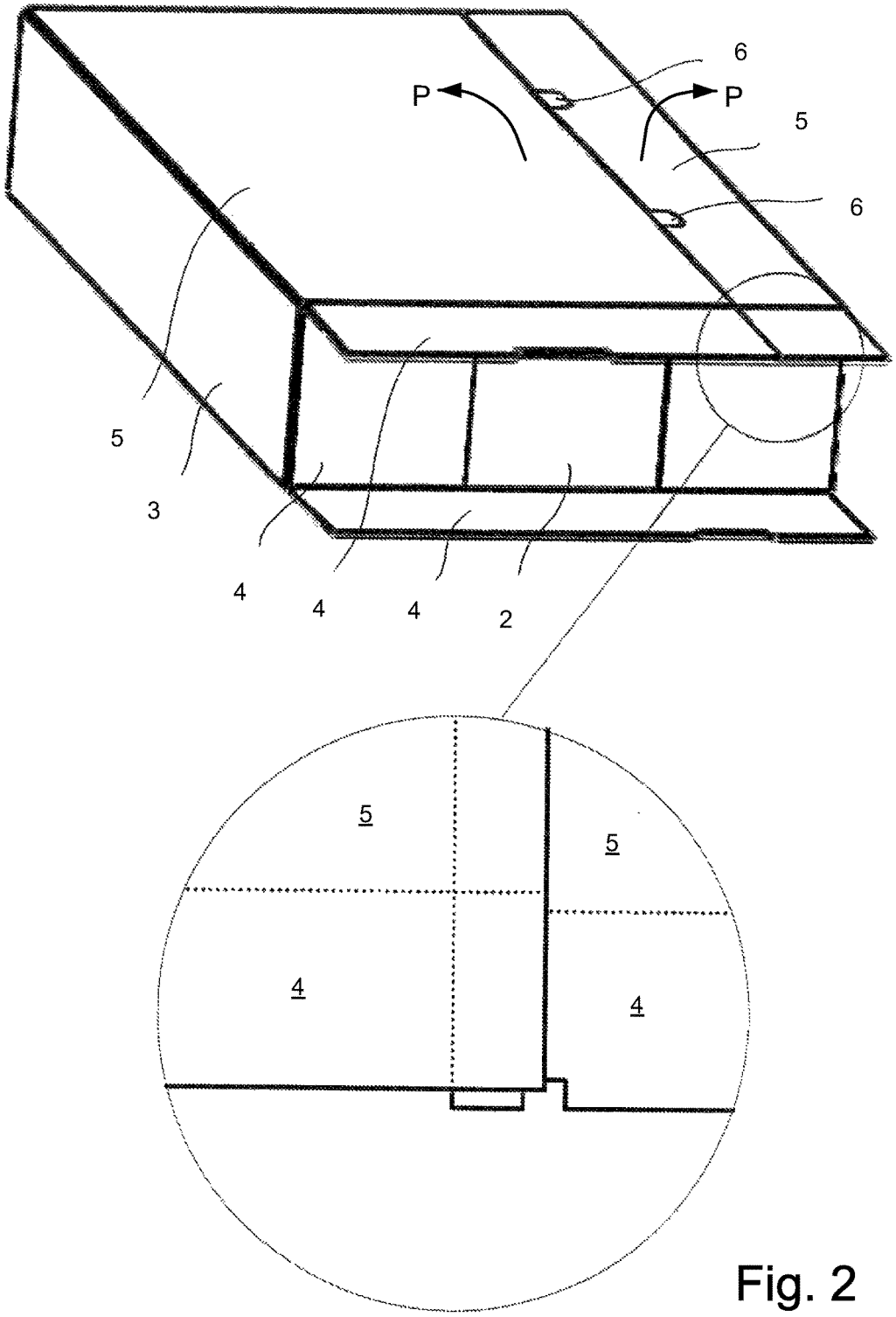
FIG. 2 shows the packaging assembled as a box.

In the embodiment shown, the lid sections are made slightly over-size so that they come to overlap, when the box has been formed as shown in FIG. 2, the enlargement showing the overlap. As illustrated with the hatching in FIG. 1, one or both of the overlapping edges may be compressed, just as for the overlapping end sections explained above. Glue or an adhesive, possibly a hot-melt, may be applied on one or both of the overlapping edges to interconnect them, but it may also be sufficient to tape the joint as presently preferred.

One of the lid sections is provided with a pair of cut-out ears 6, which can be pressed out and bend back for the formation of grips. These grips are then used for getting a hold on the lid section when opening the packaging. The size of the grips may vary widely but they will usually be between 25 mm and 100 mm long and between 10 mm and 40 mm wide. Presently a size of 50 mm×28 mm is preferred.

Similar cut-outs 7 are made in the receiving section 2. These are intended to serve as grips for use when handling the not yet opened packaging, which may be both heavy and bulky depending on the size of the window.

The use of folded-back ears as described above minimizes the risk of the user cutting his fingers on cardboard edges, but it is of course to be understood that simple recesses in the edge of the lid section or holes in the sheet member may also serve as grips.

At the fold lines separating the lid sections 5 from the end sections 4 thereon the material of the sheet member has been weakened by being partially cut at an external surface of the packaging. When the user pulls upwards and outwards on the edge of the lid section 5 as indicated by the arrows P in FIG. 2, the material is torn along these lines, thus separating the lid section from the end section, which remain attached to the end section(s) on the receiving section 2 and/or side section 3.

Similar weakenings may be provided between the side sections 3 and the end sections thereon in order to enable a complete collapsing of the packaging. As such weakenings may result in an increased risk of the packaging rupturing during handling or transportation it may be preferred to instead provide a tear-out strip. At present it is, however, preferred to simply rely on the user being able to tear the material at this place without the aid of weakenings. When doing this, the fold will contribute to guide the tear, but a somewhat messy separation at this place is not of big consequence.

Figure 3:
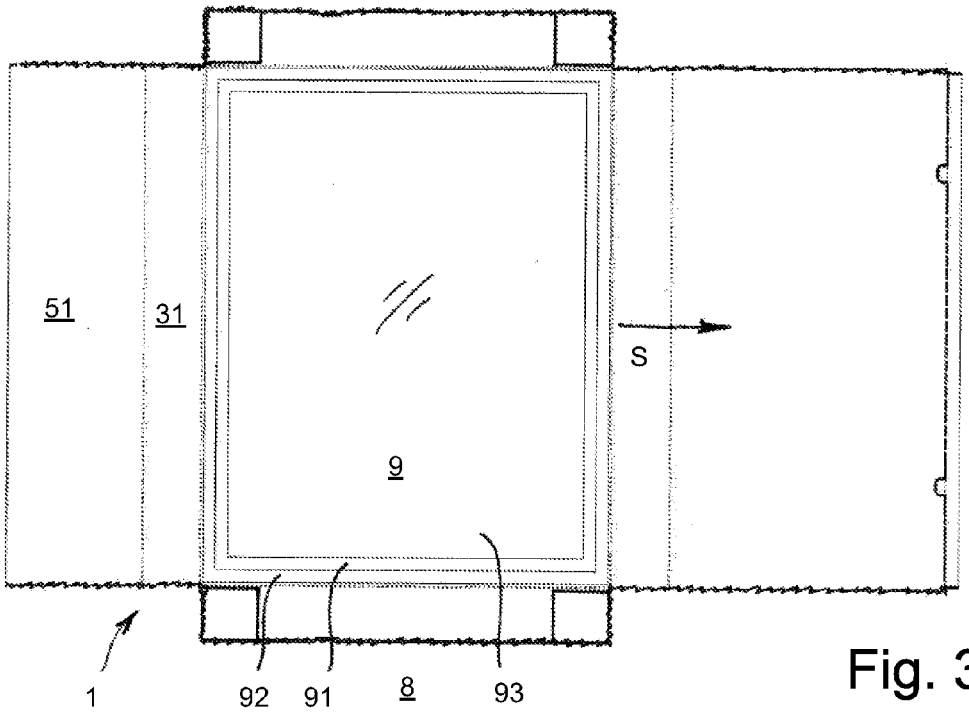
FIG. 3 shows a first embodiment of the packaging after opening.

As may be seen in FIG. 3, where the torn edges are shown with a zigzag line, the now opened packaging is lying flat on the ground or floor 8. The lid section 51 and side section 31 on the left side together forms a relatively large area, which may be used as a clean and non-abrasive surface for putting down different items such as brackets, screws, flashing components etc. during mounting of the window.

In this embodiment, this area is slightly longer than the sash 91 of the window 9, but not quite as wide. The difference in width is, however, not very big. Accordingly, if wishing to put down the window sash in a lying position, room can easily be made by shifting the window 9 or window frame 92 a bit to the right as shown by the arrow S.

In FIG. 3, the packaging has been illustrated as having a receiving section with approximately the same dimensions as the outer dimensions of the window 9.

In some cases, particularly when packing large windows, which are relatively heavy, it will however be expedient to provide strips of expanded polystyrene (EPS) or a similarly shock absorbing material around the window as shown in FIGS. 4 and 5. This has the added advantage, that the receiving section and lid sections will then be relatively larger, meaning that a larger area is available on the lid sections upon opening of the packaging.

As may be seen, the window in FIG. 4 is packed not only with a lining 10, 11 of shock absorbing material along the outer sides of the frame, consisting here of both a foam member 10 and a cardboard member 11, but also with additional inserts of different sizes and shapes. At the top a cardboard box 12 containing for example covering members to be mounted on the window during installation and having substantially the same length and height as the top member of the frame have been provided as may also be seen in FIG. 5. At the bottom a smaller but similar box 13 containing for example mounting brackets and fasteners have been provided and a foam member 14 fills the remaining space, so that the entire outer surface of the bottom frame member is protected. In this way components which have to be used together with the window are supplied in the same package, substantially without increasing the total size of the box and the window is well protected from impacts and local loads.

In this embodiment, additional shock absorbing material is provided for protecting the pane 93 and the opening mechanism 94, 95. The pane is protected by foam strips 15 provided on the upper surface of the pane, as is common on windows packed in cardboard boxes, and foam blocks 16, 17 are inserted between the ventilation flap 94 and the frame 91 and attached to the handle bar 95, respectively.

The inserts 16, 17 used at the ventilation flap and at the handle bar may extend substantially over the entire width of the window, the inserts possibly having recesses for giving room for locking mechanisms and the like, but it is presently preferred to use block-shaped inserts as shown in FIGS. 6 and 7. As may be seen, these blocks are shaped so as to fit closely to the window, thus being able to lock onto to these and contributing to keeping the window parts in the intended mutual position during storing, handling and transportation.

In FIG. 8 the window 9 has been shown without the pane so that the inserts 17 used at the handle bar are visible and in this embodiment a packaging 18 for a remote control has been added attached to the handle bar. This packaging, which also contributes to keeping the handle bar stationary during handling and transportation due to its abutment against the pane, is also shown in FIG. 9.

It is of course possible to pack all windows with inserts as shown in FIGS. 4, 5, 8 and 9, but for relatively small windows the shock absorbing capability of the cardboard box is often sufficient. As an example, windows with a two layer vacuum pane 93 and having a length of less than 1 m or a total area of less than 0.9 $m^2$ can be packed without additional shock absorbing material, while larger windows are packed with expanded polystyrene (EPS) along the frame. Windows having a length of less than 1.3 m and a total area of more than 0.9 m2 can then be packed with 15 mm EPS, windows having a length of 1.3-1.5 m with 20 mm EPS and windows longer than 1.5 m with 30 mm EPS.

Traditionally, windows made with a frame consisting at least partially of polyurethane or like materials have been packed with a layer of shock absorbing material, such as EPS, all along the outer side of the frame regardless of their size. Windows made with a wooden frame have, on the other hand, been considered less sensitive and have been packed in cardboard boxes with no or only very little shock absorbing material. For window makers making windows of both types this has lead to a large number of different packaging blanks having to be kept on stock, since each window size needs two different packagings; One for the wooden windows fitting the window size and one for the other windows with room for shock absorbing material. As a consequence of the above realization, that the amount of shock absorbing material used should be depending on the size of the window, windows of the same size can now be packed using the same sheet member, regardless of the material used for the frame and sash.

As mentioned above the packaging may contain components that are not part of the window as such but associated therewith, such as covering members, mounting brackets, fasteners or a remote control for operating the window once mounted. These components may be provided in boxes serving as inserts 12, 13, 18 as described above, but they may also be attached directly to the sheet member 1, preferably using a hot-melt or like adhesive. In that case they are preferably attached at the centre of the receiving section 2, where there will usually be space available underneath the pane 93 of the window as may be seen in FIGS. 5 and 8. It is presently considered particularly advantageous to attach larger components, which are likely to cause damage to painted or lacquered surface or to the pane, if they were to move around in the package during transport. One example of a component, which is advantageously attached to the sheet member is the skirt, which is typically used between the roofing material and a bottom flashing member attached to the bottom frame member of the window.

It is to be understood that the invention is not limited to the embodiments shown in the drawing and explained with reference thereto. On the contrary, various modifications and combinations of the features shown will be within the scope of the invention as defined by the claims.

The invention claimed is:

1. A packaging for a window comprising:

a folded sheet member having a receiving section configured for receipt of a window, two side sections, two end sections, and two lid sections together forming a top surface of the packaging in the assembled state, the sections being separated from each other by fold lines and two sections of the sheet member being interconnected;

weakenings located at the fold lines separating each lid section from the end sections, the weakenings configured with perforations or a tear-out strip, disposed at an external surface of the packaging when fully assembled, to allow the material of the sheet member to be torn by hand;

an aperture at the edge of at least one of the lid sections, the aperture providing a grip for the packaging; and, at least one cut-out in the receiving section, the at least one-cut out providing another grip for the packaging, one or more inserts arranged adjacent to the window to protect the window and keep the window in place, wherein the two lid sections:

are each connected to a side section of the sheet member, such that the sum of the widths of each lid section, measured from the fold line separating each of them from the respective side section to the opposite edge, is substantially equal to the width of the receiving section, each of the lid sections having different widths, and each of the lid sections having a width that corresponds to at least 25% of the width of the receiving section.

2. The packaging according to claim 1, wherein the sum of the width of one lid section and the width of the adjacent side section constitutes at least 75% of the width of the receiving section.

3. The packaging according to claim 1, wherein the joint between each of the lid sections is covered.

4. The packaging according to claim 1, wherein an adhesive resides where one lid section overlaps the other.

5. The packaging according to claim 1, further including end sections projecting from the receiving section or side sections.

6. The packaging according to claim 1, further including end sections projecting from the lid sections.

7. The packaging according to claim 1, wherein the one or more inserts are made from EPS or cardboard.

8. A packaging according to claim 7, wherein at least one insert is a packaging configured to hold small parts.

9. The packaging according to claim 1, wherein the sheet member is made from corrugated cardboard.

10. The packaging according to claim 1, wherein the exterior thereof is first openable at the joint between the two lid sections.

11. A kit of a plurality of differently sized packagings according to claim 1, wherein one of the lid sections has a constant width on all items of the kit.

12. The packagings according to claim 11, wherein the constant width is approximately 40 cm.

13. A packed window, comprising:

the packaging for a window according to claim 1, and a window resting on the receiving section.

* * * * *